US010001034B2

(12) United States Patent
Brune et al.

(10) Patent No.: US 10,001,034 B2
(45) **Date of Patent: *Jun. 19, 2018**

(54) ROCKER ARM ASSEMBLY FOR USE IN A VALVETRAIN OF A CYLINDER HEAD OF AN INTERNAL COMBUSTION ENGINE

(71) Applicant: GT Technologies, Westland, MI (US)

(72) Inventors: John Edmund Brune, Stockbridge, MI (US); Scott P. Smith, Temperance, MI (US)

(73) Assignee: GT Technologies, Westland, MI (US)

( * ) Notice: Subject to any disclaimer, the term of this patent is extended or adjusted under 35 U.S.C. 154(b) by 76 days.

This patent is subject to a terminal disclaimer.

(21) Appl. No.: 15/065,644

(22) Filed: Mar. 9, 2016

(65) Prior Publication Data

US 2016/0265394 A1 Sep. 15, 2016

Related U.S. Application Data

(60) Provisional application No. 62/131,023, filed on Mar. 10, 2015.

(51) Int. Cl.
*F01L 1/18* (2006.01)
*F01L 1/24* (2006.01)
(Continued)

(52) U.S. Cl.
CPC ..... *F01L 1/185* (2013.01); *F01L 1/2405* (2013.01); *F01L 2001/0535* (2013.01);
(Continued)

(58) Field of Classification Search
CPC ..... F01L 1/185; F01L 1/2405; F01L 2105/02
(Continued)

(56) References Cited

U.S. PATENT DOCUMENTS 6,302,075 B1 10/2001 Krieg et al.
6,932,040 B2 8/2005 Kadokawa et al.
(Continued)

FOREIGN PATENT DOCUMENTS

JP 2006138373 A 6/2006
JP 2008115818 A 5/2008
(Continued)

OTHER PUBLICATIONS

International Search Report and Written Opinion of the International Searching Authority for PCT International Application No. PCT/US2016/021760 dated Jun. 21, 2016.
(Continued)

*Primary Examiner* — Ching Chang
(74) *Attorney, Agent, or Firm* — Howard & Howard Attorneys PLLC

(57) ABSTRACT

A rocker arm assembly for a valvetrain having a valve, a lash adjuster, and a camshaft lobe. The rocker arm assembly includes a shaft, a bearing rotatably supported by the shaft for engaging the lobe, and a rocker arm. The rocker arm has a pad for engaging the valve, and a socket for engaging the lash adjuster. A pair of walls are disposed between the pad and socket and define a valley for accommodating the shaft. A pair of upwardly-opening arc-shaped bearing surfaces are disposed longitudinally between the pad and the socket and are spaced laterally from each other. The bearing surfaces rotatably support the shaft when the bearing engages the lobe. A pair of retention elements extend from the walls into the valley above the bearing surfaces such that the shaft is prevented from moving out of the valley in absence of engagement between the bearing and the lobe.

19 Claims, 10 Drawing Sheets

(51) Int. Cl.
*F01L 1/053* (2006.01)
*F01L 13/00* (2006.01)

(52) U.S. Cl.
CPC ... *F01L 2013/0052* (2013.01); *F01L 2105/02* (2013.01); *F01L 2250/02* (2013.01); *F01L 2250/04* (2013.01)

(58) Field of Classification Search
USPC ..... 123/90.39, 90.44
See application file for complete search history.

(56) References Cited

U.S. PATENT DOCUMENTS

| | | | |
|---|---|---|---|
| 2006/0120651 | A1 | 6/2006 | Ochi |
| 2015/0233267 | A1 | 8/2015 | Dupke |

FOREIGN PATENT DOCUMENTS

| | | | |
|---|---|---|---|
| JP | 2009079569 | A | 4/2009 |
| JP | 2013029027 | A | 2/2013 |
| WO | 2014053124 | A1 | 4/2014 |

OTHER PUBLICATIONS

Non-Final Office Action issued in U.S. Appl. No. 15/259,655 dated Mar. 30, 2018 (11 pages).

ROCKER ARM ASSEMBLY FOR USE IN A VALVETRAIN OF A CYLINDER HEAD OF AN INTERNAL COMBUSTION ENGINE

CROSS-REFERENCE TO RELATED APPLICATIONS

The present application claims priority to and all the benefits of U.S. Provisional Patent Application No. 62/131,023, filed on Mar. 10, 2015, which is hereby expressly incorporated herein by reference in its entirety.

BACKGROUND OF THE INVENTION

1. Field of Invention

The present invention relates, generally, to engine valvetrain systems and, more specifically, to a rocker arm assembly for use in a valvetrain of a cylinder head of an internal combustion engine.

2. Description of the Related Art

Conventional engine valvetrain systems known in the art typically include one or more camshafts in rotational communication with a crankshaft supported in a block, one or more intake and exhaust valves supported in a cylinder head, and one or more intermediate members for translating radial movement from lobes of the camshaft into linear movement of the valves. The valves are used to regulate the flow of gasses in and out of cylinders of the block. To that end, the valves each have a head and a stem extending therefrom. The valve head is configured to periodically seal against the cylinder head. To that end, a compression spring is typically supported in the cylinder head, is disposed about the valve stem, and is operatively attached to the valve stem via a spring retainer. The valve stem is typically supported by a valve guide that is also operatively attached to the cylinder head, whereby the valve stem extends through the valve guide and travels therealong in response to engagement from the intermediate member.

As the camshaft rotates, the intermediate member translates force from the lobes into linear movement of the valve between two different positions, commonly referred to as "valve open" and "valve closed". In the valve closed position, potential energy from the loaded spring holds the valve head sealed against the cylinder head. In the valve opened position, the intermediate member translates linear movement to compress the spring, thereby un-sealing the valve head from the cylinder head so as to allow gasses to flow into (or, out of) the cylinder of the block.

During engine operation, and particularly at high engine rotational speeds, close tolerance must me maintained between the camshaft lobe, the intermediate member, and the valve stem. Excessive tolerance results in detrimental engine performance as well as increased wear of the various valvetrain components, which leads to significantly decreased engine life. In order to maintain proper tolerances, in modern "overhead cam" valvetrain systems, the intermediate member is typically realized by a lash adjuster and a rocker arm. The lash adjuster is typically supported in the cylinder head spaced from the valve stem, with a lobe of the camshaft disposed above ("overhead of") the lash adjuster and valve stem. Conventional lash adjusters utilize hydraulic oil pressure from the engine to maintain tolerances between the valve stem and the camshaft lobe under varying engine operating conditions, such as engine rotational speed or operating temperature.

Thus, in operation, force from the camshaft lobe is translated through the rocker arm to the lash adjuster and the valve stem. To that end, the rocker arm extends between and engages the lash adjuster and the valve stem, and also includes a bearing that engages the camshaft lobe. The bearing is typically supported by a shaft that is fixed to the rocker arm. The bearing rotates on the shaft, follows the profile of the lobe of the camshaft, and translates force to the rocker arm, via the shaft, so as to open the valve.

Each of the components of an engine valvetrain system of the type described above must cooperate to effectively translate movement from the camshaft so as to operate the valves properly at a variety of engine rotational speeds and operating temperatures and, at the same time, maintain correct valvetrain tolerances. In addition, each of the components must be designed not only to facilitate improved performance and efficiency, but also so as to reduce the cost and complexity of manufacturing and assembling the valvetrain system, as well as reduce wear in operation. While engine valvetrain systems known in the related art have generally performed well for their intended purpose, there remains a need in the art for an engine valvetrain system that has superior operational characteristics, and, at the same time, reduces the cost and complexity of manufacturing the components of the system.

SUMMARY OF THE INVENTION

The present invention overcomes the disadvantages in the related art in a rocker arm assembly for use in an internal combustion engine valvetrain having a valve, a lash adjuster, and a camshaft having a lobe. The rocker arm assembly includes a shaft, a bearing rotatably supported by the shaft for engaging the lobe of the camshaft, and a rocker arm. The rocker arm has a pad for engaging the valve, and a socket spaced from the pad for engaging the lash adjuster. A pair of walls are disposed between the pad and the socket and define a valley therebetween for accommodating the shaft. A pair of upwardly-opening arc-shaped bearing surfaces are disposed longitudinally between the pad and the socket and are spaced laterally from each other. The arc-shaped bearing surfaces rotatably support the shaft when the bearing engages the lobe of the camshaft. A pair of retention elements extend from the walls at least partially into the valley and are disposed in spaced relation above the arc-shaped bearing surfaces such that the shaft is prevented from moving out of the valley in absence of engagement between the bearing and the lobe of the camshaft.

In this way, the present invention significantly reduces the complexity and packaging size of the valvetrain system and its associated components. Moreover, the present invention reduces the cost of manufacturing valvetrain systems that have superior operational characteristics, such as improved engine performance, control, lubrication, efficiency, as well as reduced vibration, noise generation, engine wear, and packaging size.

BRIEF DESCRIPTION OF THE DRAWINGS

Other objects, features, and advantages of the present invention will be readily appreciated as the same becomes better understood after reading the subsequent description taken in connection with the accompanying drawing wherein.

DETAILED DESCRIPTION OF THE INVENTION

Figure 1:
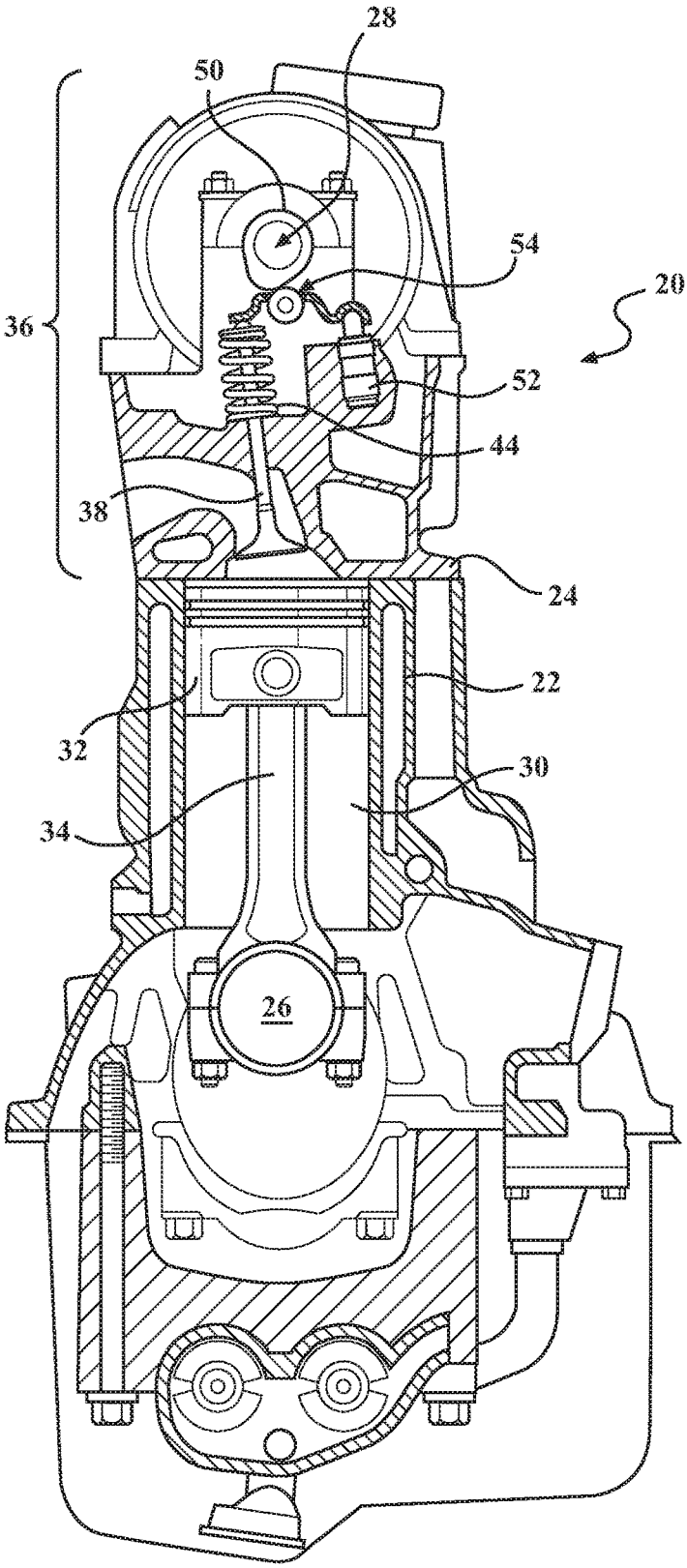
FIG. 1 is a partial front sectional view of an automotive engine with an overhead-cam configuration including a valvetrain mounted in a cylinder head.

Referring now to the drawings, where like numerals are used to designate like structure, a portion of an internal combustion engine is illustrated at 20 in FIG. 1. The engine 20 includes a block 22 and a cylinder head 24 mounted to the block 22. A crankshaft 26 is rotatably supported in the block 22, and a camshaft 28 is rotatably supported in the block 22 spaced from the crankshaft 26. The crankshaft 26 drives the camshaft 28 via a timing chain or belt (not shown, but generally known in the art). The block 22 typically includes one or more cylinders 30 in which a piston 32 is supported for reciprocal motion therealong. The piston 32 is pivotally connected to a connecting rod 34, which is also connected to the crankshaft 26. In operation, combustion in the cylinders 30 of the engine 20 moves the pistons 22 in reciprocal fashion within the cylinders 30.

Figure 2:
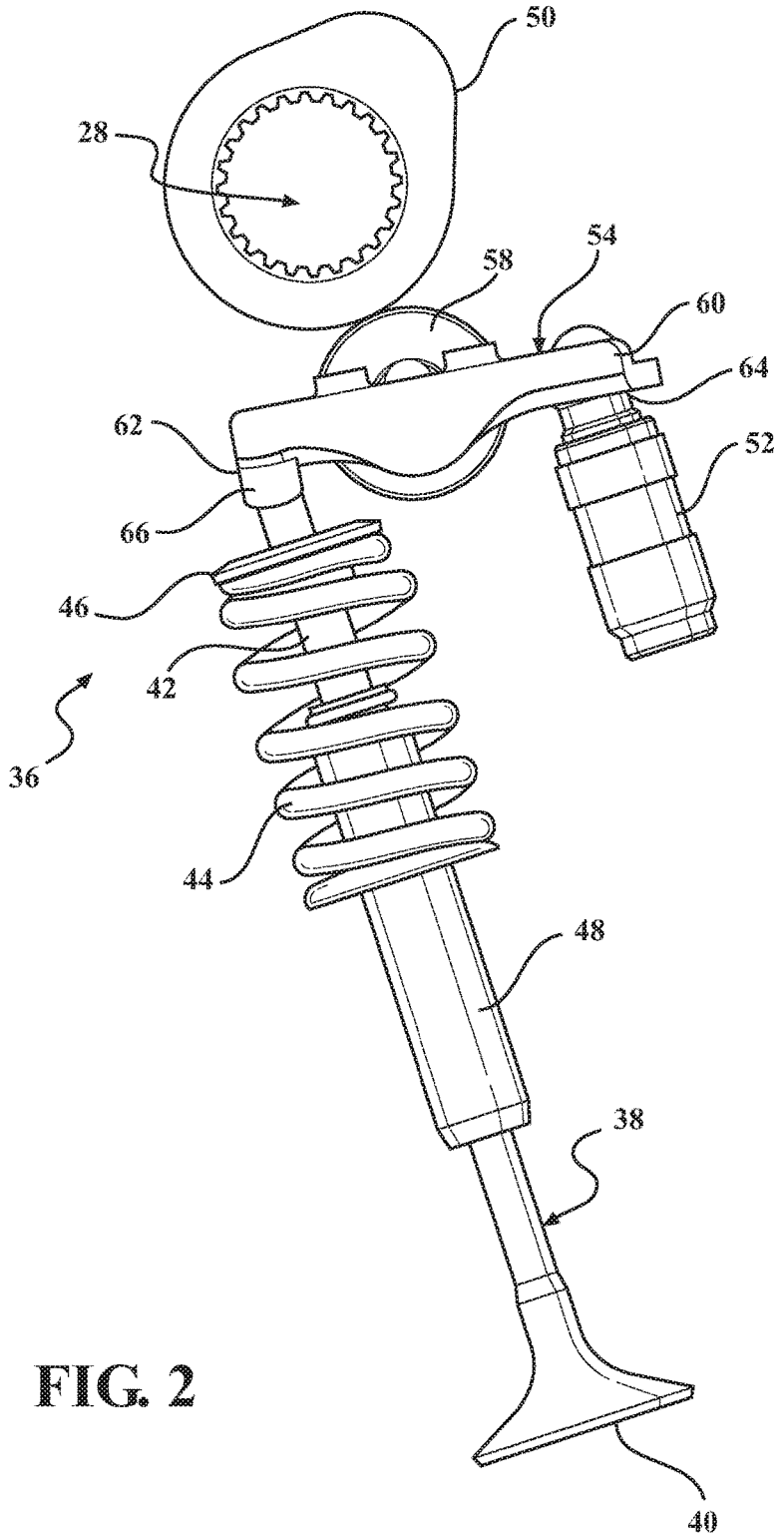
FIG. 2 is a front view of a portion of the valvetrain of FIG. 1 showing a valve, a camshaft, a lash adjuster, and a rocker arm assembly according to one embodiment of the present invention.
Figure 3:
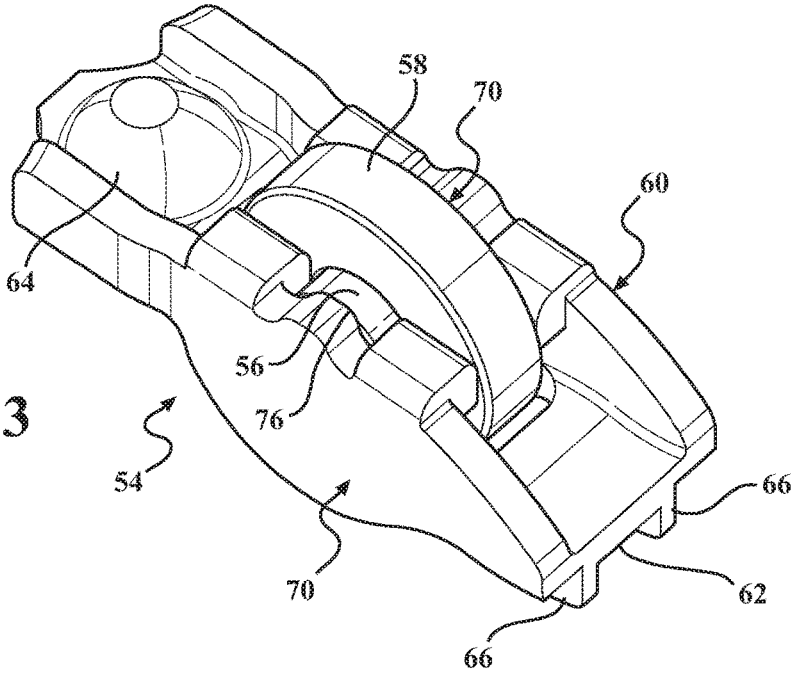
FIG. 3 is a perspective view of a first embodiment of the rocker arm assembly according to the present invention including a shaft, a bearing, and a rocker arm.

Reciprocal motion of the piston 32 generates rotational torque that is subsequently translated by the crankshaft 26 to the camshaft 28 which, in turn, cooperates with a valvetrain, generally indicated at 36, to control the flow and timing of intake and exhaust gasses between the cylinder head 24, the cylinders 30, and the outside environment. Specifically, the camshaft 28 controls what is commonly referred to in the art as "valve events," whereby the camshaft 28 effectively actuates valves 38 supported in the cylinder head 24 at specific time intervals with respect to the rotational position of the crankshaft 26, so as to effect a complete thermodynamic cycle of the engine 20. To that end, the valves 38 each have a head 40 and a stem 42 extending therefrom (see FIG. 2). The valve head 40 is configured to periodically seal against the cylinder head 24 adjacent the cylinder 30, such as with a compression spring 44 supported in the cylinder head 24, disposed about the valve stem 42, and operatively attached to the valve 38 via a retainer 46. The valve stem 42 is typically supported by a valve guide 48 that is also operatively attached to the cylinder head 24, whereby the valve stem 42 extends through the valve guide 48 and travels therealong in response to force translated via rotation of the camshaft 28 (see FIG. 2). To this end, the camshaft 28 has lobes 50 with a predetermined profile configured to cooperate with the valvetrain 36 such that radial movement from the camshaft 28 is translated into linear movement of the valves 38 so as to control the valve events, as discussed above. More specifically, the valvetrain 36 also includes a lash adjuster 52 and a rocker arm assembly, generally indicated at 54 and according to the present invention. Conventional lash adjusters 52 utilize hydraulic oil pressure from the engine 20 to maintain tolerances between the valve stem 42 and the camshaft lobe 50 under varying engine operating conditions, such as engine rotational speed or operating temperature. To that end, the lash adjuster 52 is supported in the cylinder head 24 and is spaced from the valve stem 42 and cooperates with the rocker arm assembly 54 to effect translation of force to the valve 38, as will be described in greater detail below. While the lash adjuster 52 shown in FIGS. 1 and 2 is a hydraulic lash adjuster, it will be appreciated that the lash adjuster 52 could be of any suitable type or configuration without departing from the scope of the present invention.

Those having ordinary skill in the art will recognize the valvetrain 36 described herein as forming what is commonly referred as an "overhead cam" configuration, whereby rotation of the camshaft 28 is translated to the rocker arm assembly 54 which, in turn, engages and directs force to the valve 38 and the lash adjuster 52. While the engine 20 illustrated in FIG. 1 is an inline-configured, single overhead cam, spark-ignition, Otto-cycle engine, those having ordinary skill in the art will appreciate that the engine 20 could be of any suitable configuration, with any suitable number of cylinder heads 24 and/or camshafts 28 disposed in any suitable way, controlled using any suitable thermodynamic cycle, and with any suitable type of valvetrain 36, without departing from the scope of the present invention. By way of non-limiting example, the engine 20 could be a so-called "dual overhead-cam V8" with an eight-cylinder V-configured block 22 and a pair of cylinder heads 24 each supporting a respective pair of camshafts 28 (not shown, but generally known in the art). Further, while the engine 20 is configured for use with automotive vehicles, those having ordinary skill in the art will appreciate that the present invention could be used in any suitable type of engine 20. By way of non-limiting example, the present invention could be used in connection with passenger or commercial vehicles, motorcycles, all-terrain vehicles, lawn care equipment, heavy-duty trucks, trains, airplanes, ships, construction vehicles and equipment, military vehicles, or any other suitable application without departing from the scope of the present invention.

As noted above, the present invention is directed toward a rocker arm assembly 54 for use in the engine 20 valvetrain 36. More specifically, the rocker arm assembly 54 cooperates with the valve 38, the lobe 50 of the camshaft 28, and the lash adjuster 52. As will be appreciated from the subsequent description below, the rocker arm assembly 54 can be configured in a number of different ways without departing from the scope of the present invention. By way of non-limiting example, three different embodiments of the rocker arm assembly 54 of the present invention are described herein. For the purposes of clarity and consistency, unless otherwise indicated, subsequent discussion of the rocker arm assembly 54 will refer to features and components that are common between the embodiments. Additionally, the specific differences between the embodiments will be described in detail.

Referring now to FIGS. 3-7, a first embodiment of the rocker arm assembly 54 of the present invention is shown. The rocker arm assembly 54 includes a shaft 56, a bearing 58, and a rocker arm, generally indicated at 60. The bearing 58 is rotatably supported by the shaft 56 and is adapted to engage the lobe 50 of the camshaft 28. More specifically, the bearing 58 follows the profile of the lobe 50 such that when the camshaft 28 rotates, force is translated to the bearing 58 which simultaneously rotates the bearing 58 about the shaft 56 and urges the bearing 58 away from the camshaft 28 toward the valve 38 and the lash adjuster 52. Here, force that urges the bearing 58 away from the camshaft 28 is translated to the rocker arm 60 via the shaft 56, whereby the rocker arm 60 subsequently translates force to the lash adjuster 52 and the valve stem 42 to open the valve 38 so as to control the flow of gasses into (or, out of) the cylinder 30, as discussed above. To that end, the rocker arm 60 includes a pad 62 for engaging the valve 38, and a socket 64 spaced from the pad 62 for engaging the lash adjuster 52. The pad 62 and socket 64 are adapted to press against and remain substantially engaged to the valve 38 and the lash adjuster 52, respectively, as the camshaft 28 rotates in operation (see also FIG. 2). In one embodiment, the rocker arm 60 also includes a pair of pad braces 66 depending from the pad 62 that help align the rocker arm assembly 54 to the valve 38, such as during installation of the rocker arm assembly 54 into the cylinder head 24. Similarly, the socket 64 has a curved pocket 68 for accommodating and aligning with a portion of the lash adjuster 52 (not shown in detail, but generally known in the art). However, those having ordinary skill in the art will appreciate that the pad 62 and/or socket 64 could be configured in any suitable way without departing from the scope of the present invention.

Figure 4:
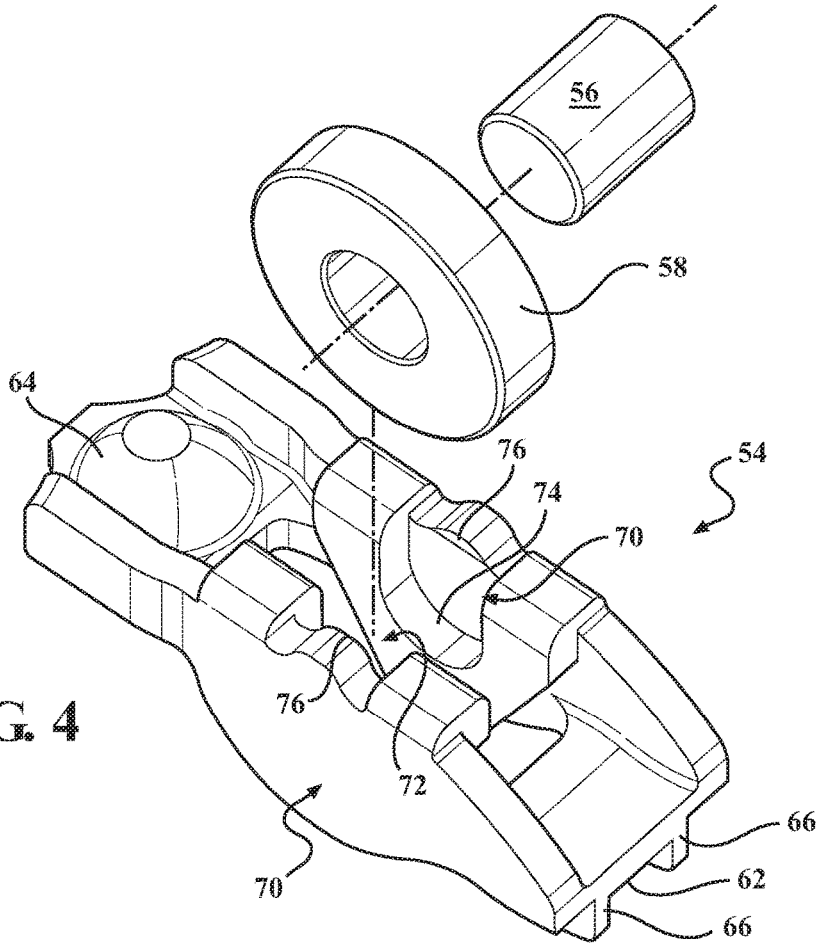
FIG. 4 is an exploded perspective view of the rocker arm assembly of FIG. 3.
Figure 5:
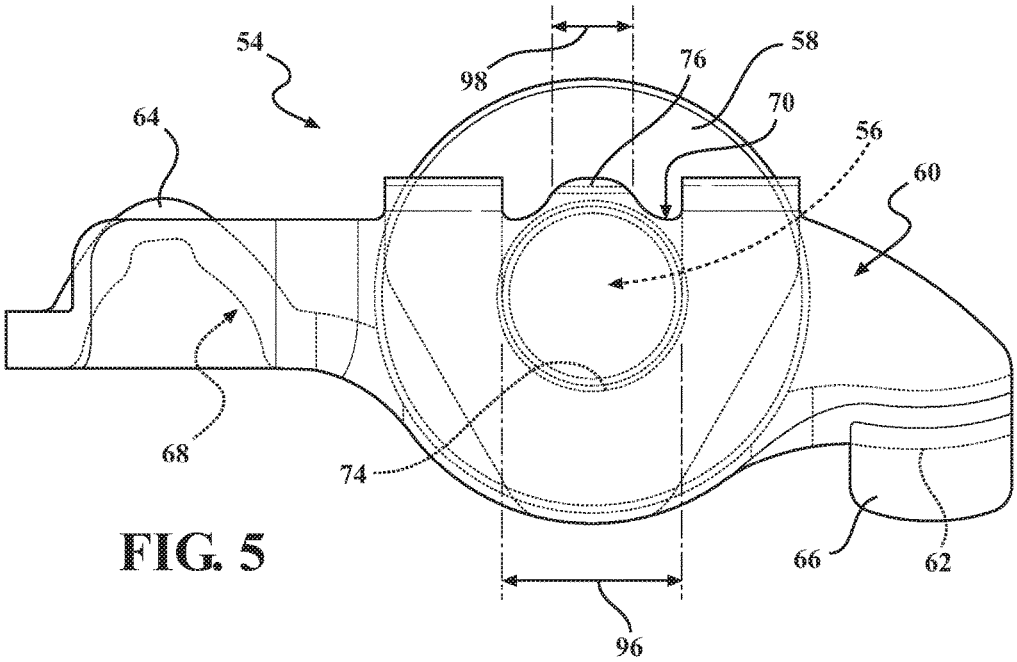
FIG. 5 is a front plan view of the rocker arm assembly of FIG. 3 with the shaft, a portion of the bearing, and internal features and structure of the rocker arm shown in phantom.
Figure 6:
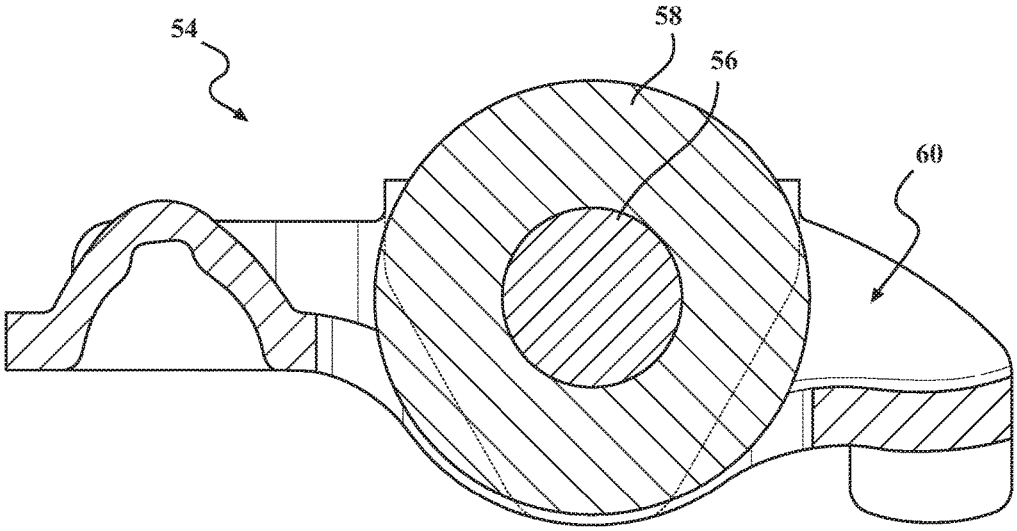
FIG. 6 is a sectional view taken along a longitudinal centerline of the rocker arm assembly of FIG. 3.
Figure 7:
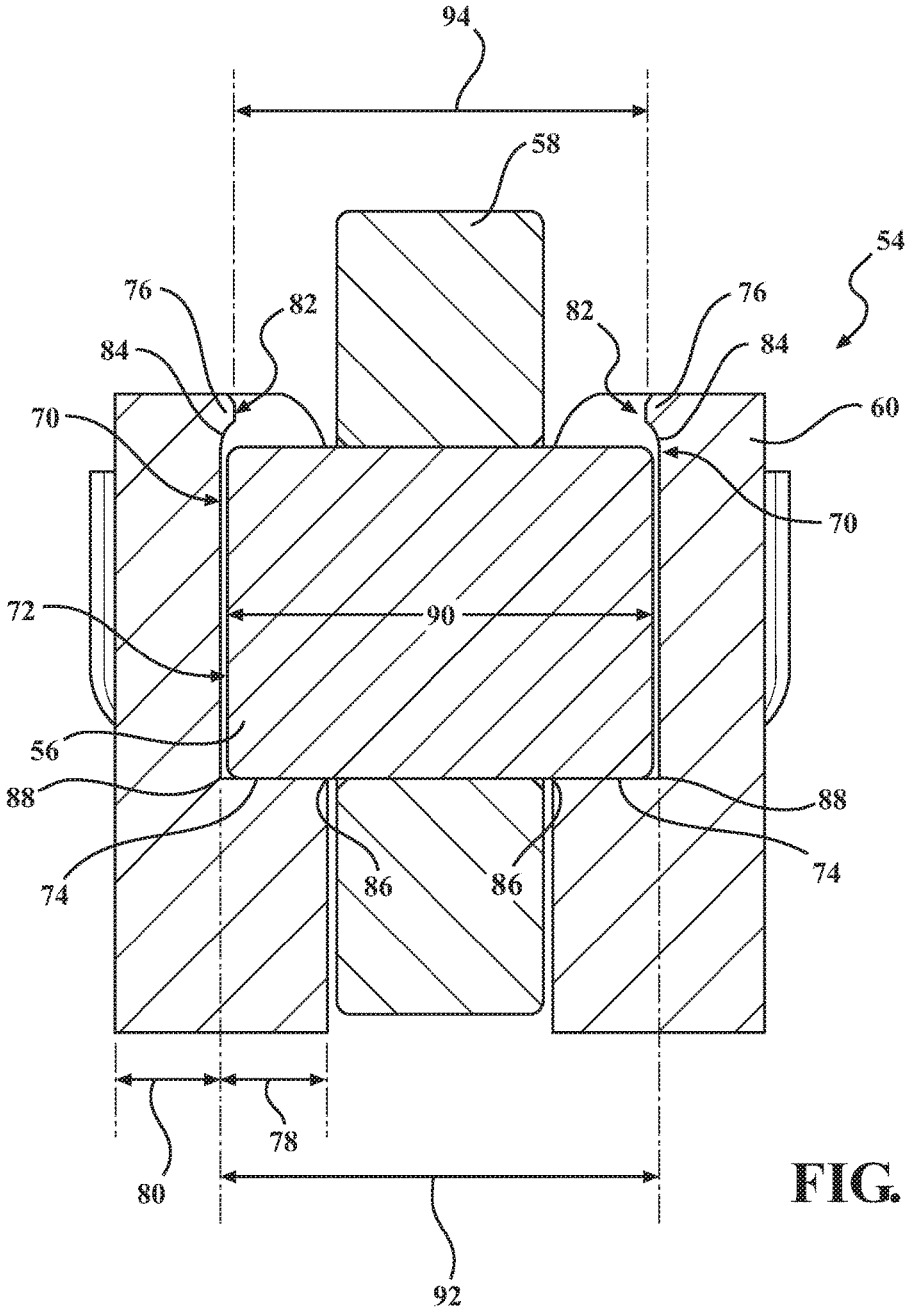
FIG. 7 is a sectional view taken along a lateral centerline of the shaft of the rocker arm assembly of FIG. 3.
Figure 8:
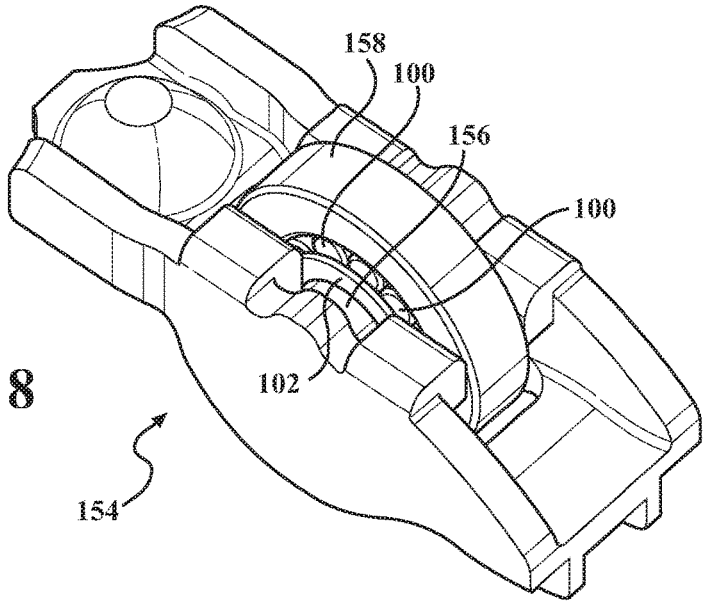
FIG. 8 is a perspective view of a second embodiment of the rocker arm assembly according to the present invention including a shaft, a bearing, and a rocker arm.
Figure 9:
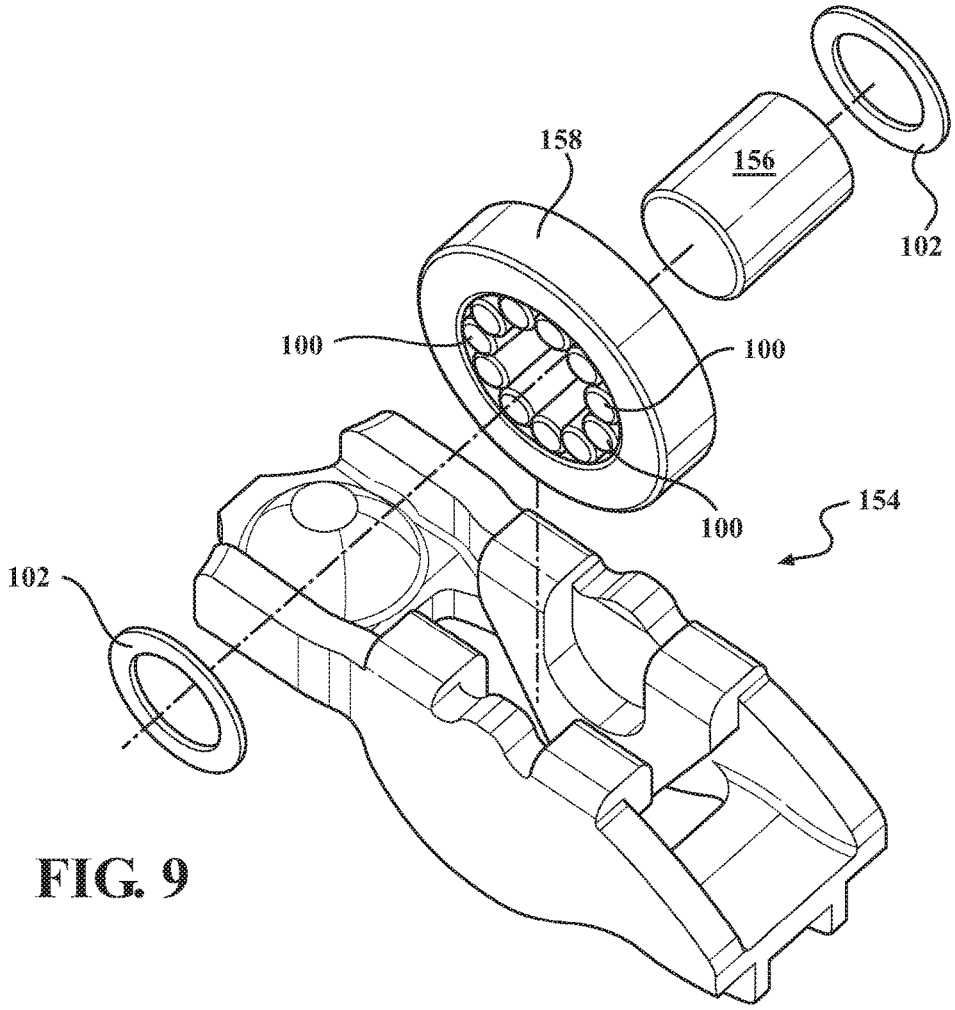
FIG. 9 is an exploded perspective view of the rocker arm assembly of FIG. 8.
Figure 10:
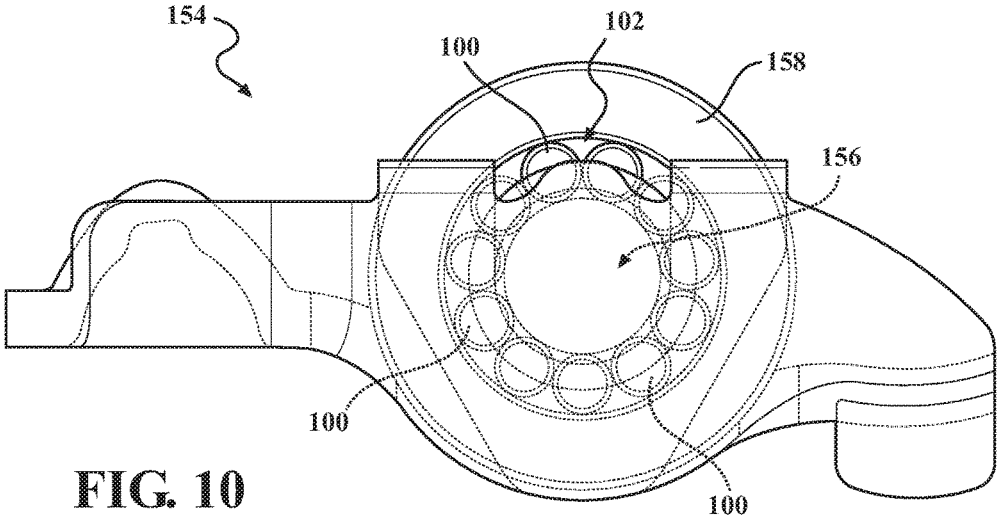
FIG. 10 is a front plan view of the rocker arm assembly of FIG. 8 with the shaft, a portion of the bearing, an internal features and structure of the rocker arm shown in phantom.
Figure 11:
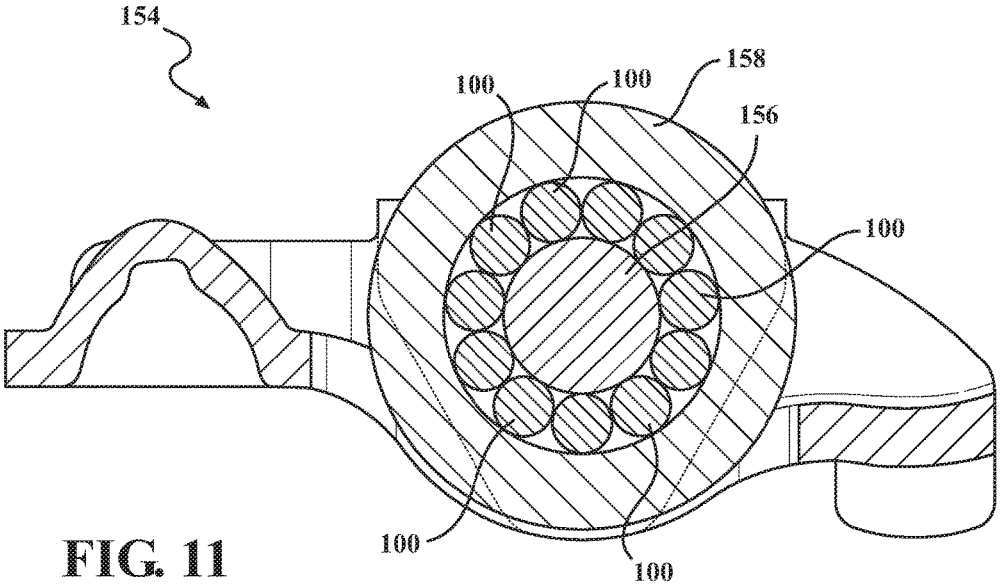
FIG. 11 is a sectional view taken along a longitudinal centerline of the rocker arm assembly of FIG. 8.
Figure 12:
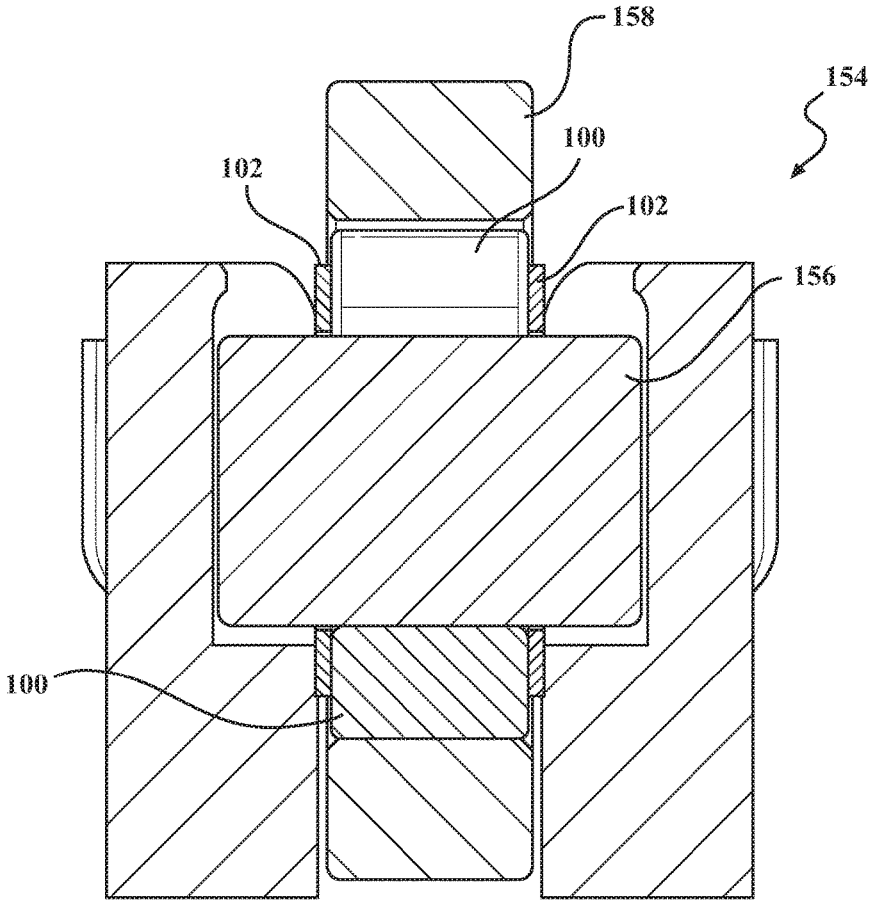
FIG. 12 is a sectional view taken along a lateral centerline of the shaft of the rocker arm assembly of FIG. 8.
Figure 13:
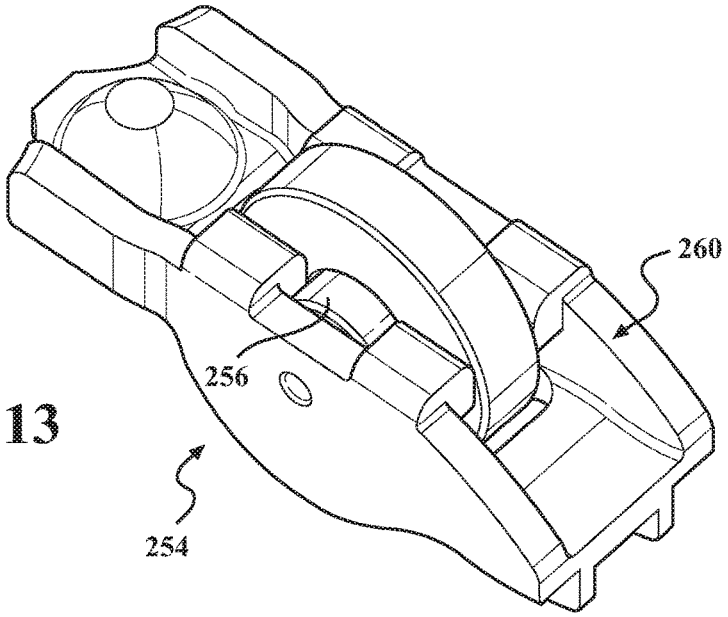
FIG. 13 is a perspective view of a third embodiment of the rocker arm assembly according to the present invention including a shaft, a bearing, and a rocker arm.
Figure 14:
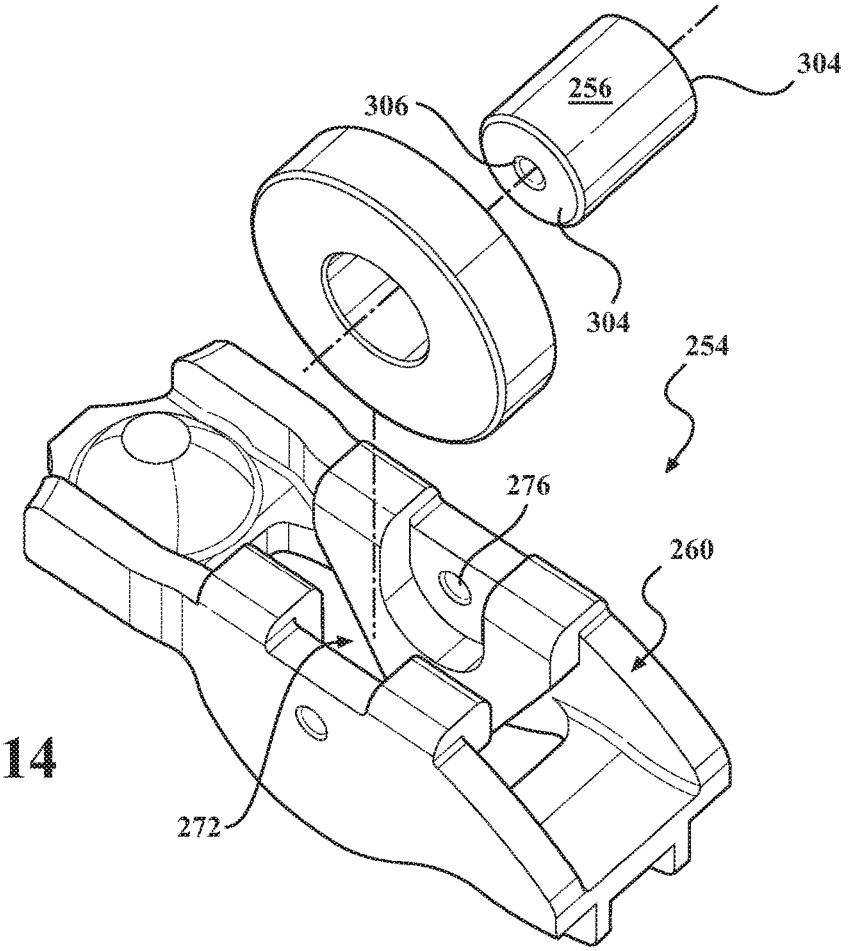
FIG. 14 is an exploded perspective view of the rocker arm assembly of FIG. 13.
Figure 15:
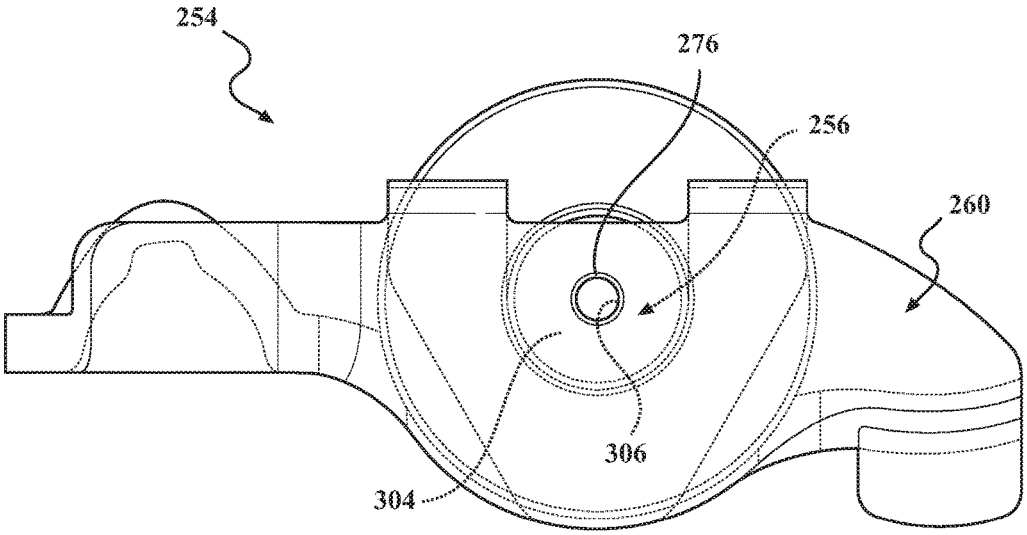
FIG. 15 is a front plan view of the rocker arm assembly of FIG. 13 with a portion of the shaft, a portion of the bearing, and internal features and structure of the rocker arm shown in phantom.

As is shown best in FIG. 4, the rocker arm 60 includes a pair of walls 70 disposed between the pad 62 and the socket 64. The walls 70 define a valley therebetween, generally indicated at 72, for accommodating the shaft 56. The rocker arm 60 also includes a pair of upwardly-opening arc-shaped bearing surfaces, generally indicated at 74. The arc-shaped bearing surfaces 74 are spaced laterally from each other and are disposed longitudinally between the pad 62 and the socket 64. The arc-shaped bearing surfaces 74 rotatably support the shaft 56 when the bearing 58 engages the lobe 50 of the camshaft 28, as is described in greater detail below. The rocker arm 60 also includes a pair of retention elements 76 extending from the walls 70 at least partially into the valley 72. The retention elements 76 are disposed in spaced relation above the arc-shaped bearing surfaces 74 such that the shaft 56 is prevented from moving out of the valley 72 in absence of engagement between the bearing 58 and the lobe 50 of the camshaft 28. When the rocker arm assembly 54 is installed into the cylinder head 24 and engages the lobe 50 of the camshaft 28, a certain amount of pre-load force is exerted against the bearing 58 which, in turn, pushes the shaft 56 against the arc-shaped bearing surfaces 74, thereby pushing the rocker arm 60 against the valve 38 and the lash adjuster 52. This pre-load force keeps the shaft 56 against the arc-shaped bearing surfaces 74 in operation. As such, the shaft 56 need only be radially supported by the rocker arm 60 and not radially constrained. To this end, the retention elements 76 keep the shaft 56 in the valley 72 until the rocker arm assembly 54 is installed; specifically, until the bearing 58 engages the lobe 50 of the camshaft 28. In one embodiment, the retention elements 76 are spaced above the shaft 56 when the shaft engages the arc-shaped bearing surfaces 74 (see FIG. 7).

In the embodiments illustrated throughout the figures, the rocker arm 60 is formed as a unitary, one-piece component. More specifically, the rocker arm 60 is manufactured from a single piece of sheet steel that is stamped and bent to shape. Thus, as shown best in FIG. 7, the arc-shaped bearing surfaces 74 each have a bearing width 78 that is substantially equal to a wall width 80 of the walls 70. However, those having ordinary skill in the art will appreciate that the rocker arm 60 could be formed or otherwise manufactured in any suitable way from any suitable material without departing from the scope of the present invention.

As noted above, the retention elements 76 extend from the walls 70 into the valley 72. As shown best in FIGS. 4 and 7, in one embodiment, the retention elements 76 each extend from one of the walls 70 to a retention element edge 82, and each retention element 76 further includes a lip portion 84 merging the retention element edge 82 with the wall 70. As shown best in FIG. 7, the lip portions 84 have a substantially curved profile. In one embodiment, the arc-shaped bearing surfaces 74 each have an inner lateral edge 86 and an outer lateral edge 88, and the retention element edges 82 are each positioned: laterally between the inner lateral edge 86 and the outer lateral edge 88 of the respective arc-shaped bearing surface 74; and vertically above the respective arc-shaped bearing surfaces 74 (see FIG. 7). However, it will be appreciated that the edges 82, 86, 88 and/or the lip portion 84 be configured in a number of different ways, without departing from the scope of the present invention. Moreover, the retention elements 76 could be configured in any suitable way sufficient to keep the shaft 56 in the valley 72 until the bearing 58 engages the lobe 50 of the camshaft 28 without departing from the scope of the present invention.

As noted above, the shaft 56 rotates with respect to the arc-shaped bearing surfaces 74. By allowing the shaft 56 to rotate independent from the bearing 58, spalling is substantially eliminated that may otherwise occur between the shaft 56 and the bearing 58 and/or arc-shaped bearing surfaces 74. Thus, the rocker arm assembly 54 can be designed to optimize material and/or application specifications so as to decrease cost and maximize component life. In addition to rotating with respect to the rocker arm 60, the shaft 56 may also be configured to move axially with respect to the rocker arm 60 so as to further reduce wear and increase component life. To that end, in one embodiment, the shaft 56 has a shaft length 90, the rocker arm 60 has an arc outer lateral edge distance 92 measured between the outer lateral edges 88 of the arc-shaped bearing surfaces 74, and a ratio between the shaft length 90 and the arc outer lateral edge distance 92 is greater than 0.9:1 (see FIG. 7). Similarly, in one embodiment, the rocker arm 60 has a retention element distance 94 measured between the retention element edges 82 of the retention elements 76, and a ratio between the shaft length 90 and the retention element distance 94 is greater than 0.92:1. Further, in one embodiment, the shaft 56 has a shaft diameter 96 and the retention elements of the rocker arm 60 each have a longitudinal element width 98 that is less than the shaft diameter 56 (see FIG. 5). These relationships help ensure that the shaft 56 remains within the valley 72 while, at the same time, allowing rotation and slight axial movement so as to optimize performance and component life, as discussed above. In the representative embodiments illustrated herein, the retention elements 76 are similarly shaped and, in one embodiment, have substantially equivalent longitudinal element widths 98. However, as noted above, the retention elements 76 could be configured in any suitable way, with the same or different configurations from one another, without departing from the scope of the present invention.

As shown best in FIG. 4, in the first embodiment of the rocker arm assembly 54 of the present invention, the bearing 58 is supported directly on the shaft 56 in a conventional journal bearing arrangement. However, as noted above, a second embodiment of the rocker arm assembly 54 of the present invention is shown in FIGS. 8-12. The second embodiment is substantially similar to the first embodiment. As such, in the description that follows, only non-identical components of the second embodiment of the rocker arm assembly 54 are described in detail and are provided with the same reference numerals used in connection with the first embodiment of the rocker arm assembly 54 increased by 100.

Referring now to FIGS. 8-12, in the second embodiment of the rocker arm assembly 154, a plurality of needle bearing elements 100 are interposed between the shaft 156 and the bearing 158 in a conventional needle bearing arrangement. In this embodiment, the rocker arm assembly 158 may also include a pair of retention rings 102 disposed on either side of the bearing 158 that cooperate with the shaft 156 so as to secure the needle bearing elements 100 axially. The needle bearing arrangement employed by the bearing 158 and the needle bearing elements 100 affords increased component life and reduced wear of the rocker arm assembly 154. However, those having ordinary skill in the art will appreciate that any suitable bearing arrangement could be utilized, with or without the use of needle bearing elements 100 and/or retention rings 102, without departing from the scope of the present invention.

As noted above in connection with the first embodiment of the rocker arm assembly 54 of the present invention, the retention elements 76 can be designed or otherwise implemented in a number of different ways without departing from the scope of the present invention. To that end, and as noted above, a third embodiment of the rocker arm assembly 54 of the present invention is shown in FIGS. 13-16. The third embodiment is substantially similar to the first embodiment. As such, in the description that follows, only non-identical components of the third embodiment of the rocker arm assembly 54 are described in detail and are provided with the same reference numerals used in connection with the first embodiment of the rocker arm assembly 54 increased by 200.

Figure 16:
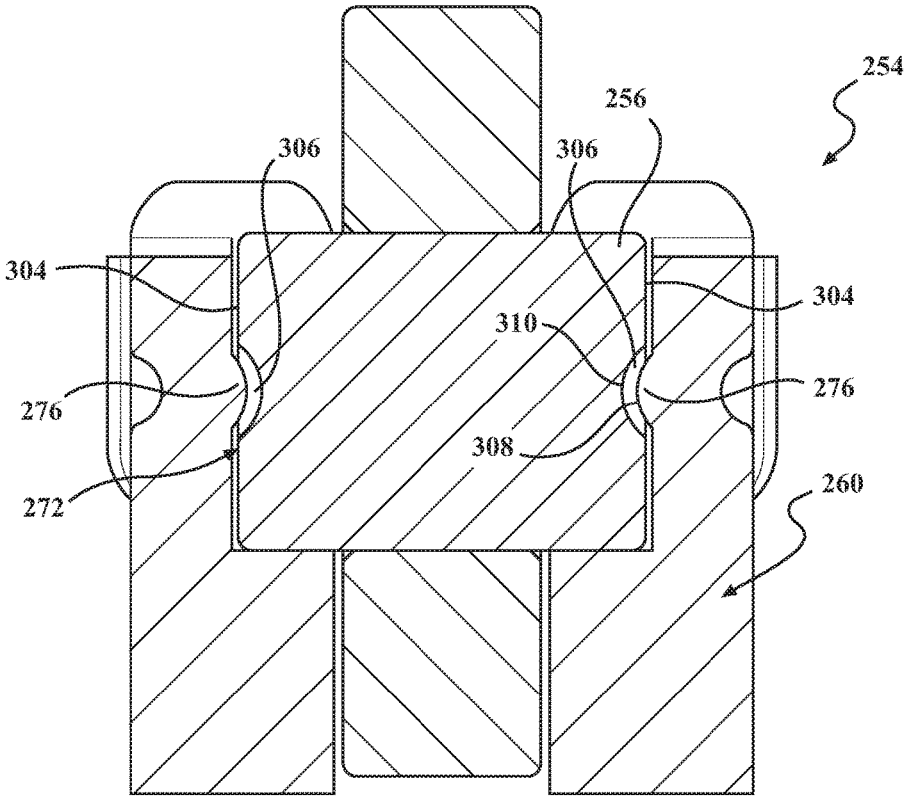
FIG. 16 is a sectional view taken along a lateral centerline of the shaft of the rocker arm assembly of FIG. 13.

Referring now to FIGS. 13-16, in the third embodiment of the rocker arm assembly 254, the retention elements 276 of the rocker arm 260 have a substantially convex profile, and the shaft 256 extends between opposing shaft ends 304 with a dimple 306 defined in each of the shaft ends 304 (see FIG. 16). In this embodiment, the dimples 306 have a substantially concave profile that corresponds with the convex profile of the retention elements 276. Here, the convex profile of the retention elements 276 of the rocker arm 260 is defined along a first radius 308 and the concave profile of the dimples 260 of the shaft 256 is defined along a second radius 310 that is greater than the first radius 308 (see FIG. 16). Moreover, the dimples 306 are substantially concentrically aligned with respect to the retention elements 276. Similarly, the dimples 306 are substantially concentrically aligned with respect to the shaft 256. This arrangement facilitates ease of installation of the shaft 256 into the valley 272 of the rocker arm 60 and, at the same time, ensures that the retention elements 276 keep the shaft 256 in the valley 272. However, as noted above, those having ordinary skill in the art will appreciate that the retention elements 276 could be configured, oriented, or otherwise shaped in any suitable way without departing from the scope of the present invention.

In this way, the rocker arm assembly 54, 154, 254 of the present invention significantly reduces the cost and complexity of manufacturing and assembling the valvetrain 36 and associated components. Specifically, it will be appreciated that the configuration of the retention elements 76, 276 enables consistent and simple installation of the shaft 56, 156, 256 to the rocker arm 60, 260 while, at the same time, ensuring that the shaft 56, 156, 256 is kept within the valley 72, 272 until the bearing 58, 158 engages the lobe 50 of the camshaft 28. Specifically, it will be appreciated that the configuration of the rocker arm assembly 54, 154, 254 allows the shaft 56, 156, 256 to be retained with respect to the rocker arm 60, 260 until the rocker arm assembly 54, 154, 254 is installed in the cylinder head 24, thereby significantly reducing the cost and complexity of manufacturing and assembling the valvetrain 36. Further, it will be appreciated that the present invention affords opportunities for superior engine 20 operational characteristics, such as improved performance, component life and longevity, efficiency, weight, load and stress capability, and packaging orientation.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A rocker arm assembly for use in an internal combustion engine valvetrain having a valve, a lash adjuster, and a camshaft having a lobe; said rocker arm assembly comprising:

a shaft having a diameter;

a bearing rotatably supported by said shaft for engaging the lobe of the camshaft; and a rocker arm having:

a pad for engaging the valve, a socket spaced from said pad for engaging the lash adjuster, a pair of walls disposed between said pad and said socket and defining a valley therebetween for accommodating said shaft, a pair of upwardly-opening arc-shaped bearing surfaces spaced laterally from each other and disposed longitudinally between said pad and said socket for rotatably supporting said shaft when said bearing engages the lobe of the camshaft, and a pair of retention elements extending from said walls at least partially into said valley and disposed in spaced relation above said arc-shaped bearing surfaces and wherein said retention elements of said rocker arm each have a longitudinal element width that is less than said shaft diameter such that said shaft is prevented from moving out of said valley in absence of engagement between said bearing and the lobe of the camshaft.

2. The rocker arm assembly as set forth in claim 1, wherein said retention elements of said rocker arm are spaced above said shaft when said shaft engages said arc-shaped bearing surfaces.

3. The rocker arm assembly as set forth in claim 1, wherein said pair of retention elements of said rocker arm each extend from one of said walls and terminate in a retention element edge, and wherein each retention element includes a lip portion merging the associated retention element edge with said respective wall.

4. The rocker arm assembly as set forth in claim 3, wherein each of said lip portions of said rocker arm have a substantially curved profile.

5. The rocker arm assembly as set forth in claim 3, wherein said arc-shaped bearing surfaces of said rocker arm each have an inner lateral edge and an outer lateral edge, and wherein each of said retention element edges are each positioned:

above one of said respective arc-shaped bearing surfaces; and laterally between said inner lateral edge and said outer lateral edge of said respective arc-shaped bearing surface.

6. The rocker arm assembly as set forth in claim 5, wherein said shaft has a shaft length, and wherein a ratio between said shaft length and an arc outer lateral edge distance measured between said outer lateral edges of said arc-shaped bearing surfaces of said rocker arm is greater than 0.9:1.

7. The rocker arm assembly as set forth in claim 6, wherein a ratio between said shaft length and a distance measured between said pair of retention elements of said rocker arm is greater than 0.92:1.

8. The rocker arm assembly as set forth in claim 1, wherein said longitudinal element widths of said retention elements of said rocker arm are substantially equal.

9. The rocker arm assembly as set forth in claim 1, wherein said arc-shaped bearing surfaces of said rocker arm each have a bearing width, and wherein said walls each have a wall width that is substantially equal to said bearing width.

10. The rocker arm assembly as set forth in claim 1, wherein said rocker arm is a unitary, one-piece component.

11. The rocker arm assembly as set forth in claim 1, wherein said rocker arm is manufactured from sheet steel.

12. The rocker arm assembly as set forth in claim 1, wherein said shaft extends between shaft ends with a dimple defined in each of said shaft ends.

13. The rocker arm assembly as set forth in claim 12, wherein said dimples are substantially concentrically aligned with said shaft.

14. The rocker arm assembly as set forth in claim 12, wherein said dimples of said shaft have a substantially concave profile.

15. The rocker arm assembly as set forth in claim 14, wherein said retention elements of said rocker arm have a substantially convex profile.

16. The rocker arm assembly as set forth in claim 15, wherein said retention elements of said rocker arm are substantially concentrically aligned with said dimples of said shaft.

17. The rocker arm assembly as set forth in claim 15, wherein said convex profile of said retention elements of said rocker arm is defined along a first radius, and wherein said concave profile of said dimples of said shaft is defined along a second radius that is greater than said first radius.

18. The rocker arm assembly as set forth in claim 1, wherein said bearing is further defined as a journal bearing supported directly on said shaft.

19. The rocker arm assembly as set forth in claim 1, wherein said bearing is further defined as a needle bearing having a plurality of needle bearing elements interposed between said bearing and said shaft.

* * * * *